US006473912B2

(12) United States Patent
Preciado-Villanueva

(10) Patent No.: US 6,473,912 B2
(45) Date of Patent: Nov. 5, 2002

(54) SIPHON FLUSH APPARATUS

(76) Inventor: Jose-Jaime Preciado-Villanueva, Heriberto Frias No. 550-2, Col. Narvarte, 03020 Mexico, D.F. (MX)

( * ) Notice: Subject to any disclaimer, the term of this patent is extended or adjusted under 35 U.S.C. 154(b) by 0 days.

(21) Appl. No.: 09/782,603

(22) Filed: Feb. 14, 2001

(65) Prior Publication Data

US 2002/0108169 A1 Aug. 15, 2002

(51) Int. Cl.[7] ..... E03D 1/07
(52) U.S. Cl. ..... 4/372; 4/377
(58) Field of Search ..... 4/372, 377

(56) References Cited

U.S. PATENT DOCUMENTS

| | | | |
|---|---|---|---|
| 3,851,338 A | 12/1974 | Roosa | |
| 4,024,589 A | 5/1977 | Klessig | |
| 4,268,924 A | 5/1981 | Price et al. | |
| 5,228,145 A | 7/1993 | Osmond | |
| 5,230,102 A | 7/1993 | Osmond | |
| 5,685,027 A | 11/1997 | Jensen | |

FOREIGN PATENT DOCUMENTS

| | | | | |
|---|---|---|---|---|
| CH | 565287 | * | 8/1975 | ..... 4/372 |
| EP | 0 209 477 A1 | | 1/1987 | |
| EP | 0 302 150 A1 | | 2/1989 | |
| GB | 10193 | * | 8/1890 | ..... 4/372 |
| GB | 16054 | * | 8/1902 | ..... 4/372 |
| GB | 805876 | * | 12/1958 | ..... 4/377 |
| GB | 2 041 421 A | | 9/1980 | |
| GB | 2 167 778 A | | 6/1986 | |
| IT | 611340 | * | 10/1960 | ..... 4/377 |
| WO | WO98/26135 | | 6/1998 | |

* cited by examiner

*Primary Examiner*—Robert M. Fetsuga
(74) *Attorney, Agent, or Firm*—Browdy and Neimark, P.L.L.C.

(57) ABSTRACT

A siphon flush apparatus is described which by means of a sliding conduct coupled to a discharge conduct allows the formation of a siphon during the flush operation of a cistern without the need of a jet stream of water, valve means or a piston to initiate said siphon. In addition, the apparatus of the present invention can remain without any leakage into the flushing tube when it is at rest position and need not an additional overflowing discharging pipe to drain an excess of water when the supply valve of the cistern fails.

20 Claims, 4 Drawing Sheets

SIPHON FLUSH APPARATUS

FIELD OF THE INVENTION

The present invention is related with the techniques for flushing cisterns, and more particularly, it is related to a siphon flush apparatus.

BACKGROUND OF THE INVENTION

As it is widely known, several types of flushing devices have been used for many years in order to flush cisterns of toilettes.

Nevertheless, the main problem in almost all of the flushing devices that are known up to date is leakage. Some of the recent developments intended to give the best performance in flushing operations by incorporating the siphon principle to start the water discharge from the cistern into the toilet bowl for its cleaning.

One example of the above is U.S. Pat. No. 3,851,338, which describes a flushing device for toilets where a siphon empties a flush tank and becomes inactive until the tank is full and flushed again. The system includes a float that is slidably mounted in a chamber so that when the float is forced down for flushing, water is forced from the float chamber into a siphon, either alone or with water from an inlet valve, to start the siphon action to empty the flush tank. When the float is forced down, the water inlet valve is opened to supply additional water to start the siphon. Then the inlet valve remains open until the tank is refilled.

The invention described above presents the inconvenience of needing means for preventing a reverse flow from the tank into the inlet pipe when a failure in the water supply occurs. In addition to the fact that the formation of the siphon needs a complex construction in regard to both, elements and space.

As it will be shown by the analysis of the prior art, the main differences between the known devices that use a siphon for flushing is the method by which the siphon is formed, which at the end allows a better performance when flushing.

Another example of siphon construction is U.S. Pat. No. 4,024,589. This patent discloses a flush valve of siphon type with a supply jet feeding into the up-leg and having a flap-float valve which is responsive to water level and serves to divert the supply flow to refill the tank after completion of the flushing action. In the preferred embodiment, the float of the float-flap valve is disposed in a chamber that insures that it will operate only after full completion of the flushing action.

The invention described above is a combination of a float flap valve directly put in the inlet water, as well known in the prior art, and a siphon with a jet stream to initiate the siphonic effect. However, it has the inconvenience of having a complex design that makes it difficult to give maintenance and keep fit. Moreover, its performance depends, in a great extent, on the effectiveness of the flap-float valve, which in turn can be easily susceptible to leakage.

Similarly, British patent No. 2041421 describes another siphon unit for flushing cisterns that has a flushing piston as well as a "U" shaped construction. One arm of the siphon tube forms an inlet for communication with the cistern to fill said arm to a level corresponding to the level of liquid in the cistern. The other arm, which forms the outlet, allows discharge for flushing. The main inconvenience of this system is the needing of a piston inside a chamber that is formed at the inlet. Therefore, it is needed a very good sealing at the piston and a considerable force to push the water and form the siphon. In addition, maintenance of the apparatus is very complicated.

Another "U" shaped siphon apparatus is described in U.S. Pat. No. 4,268,924, having a similar construction to that described in last paragraph but having some differences at the valve for forcing water to enter into the system.

Other kind of siphon assembly for flushing cisterns is described in British patent No. 2167778, wherein a siphon assembly comprises two parts. The first part includes a down leg of the siphon duct, which lower end is mounted in the cistern base; and, the second part includes the up-leg and the inlet chamber in which the flushing piston is received. The parts are releasably connected by a push fit spigot and a socket joint that is secured by a removable pin received transversely through location formations on each part near the top of the legs, further formations located near the bottoms of the legs being received in vertical sliding relationship.

The latter invention has yet the inconvenience of needing a flushing piston to initiate the siphoning operation, besides of having a complex assembly.

Another kind of system to form the siphon is shown in European Patent No. EP0209477, which presents a flushing device having a floating siphon bell for flushing tanks that include an external tubular casing and the floating siphon bell inside. This system needs a complex valve system, which makes it difficult to maintain as well as expensive.

Another bell shaped siphon is that described in European Patent No. 0302150, which describes a siphon having an inverted flow-directing element positioned over a down pipe. At the lower end of the bell, valve means are fixed in relation to the down pipe. By depressing the bell, a siphonic action is initiated which flushes the cistern. In order to start the siphon, it is also needed the equivalent of the piston of other inventions, since this bell includes a diaphragm, which functions as a check valve that allows the water to enter into the bell when it is used. Such water is forced by the diaphragm into a restriction of the bell when the bell is pushed down, thus forming the siphon. In this case, the formation of the siphon is highly dependent on the diaphragm performance. Furthermore, the restriction necessary to form the siphon is very severe, so that a very high pressure drop is caused, which results in a deficient flush of the toilet since the flow area at the down pipe is greater than the flow area at the upper part of the bell.

In addition, the discharge tube should be over the water level. Although this prevents water leakage effectively when the flush is not being used, it is also the cause of needing the flow restriction and the diaphragm at the bell for allowing the formation of the siphon.

OBJECTS OF THE INVENTION

Having in mind the drawbacks of the prior art, it is an object of the present invention to provide a siphon flush apparatus, which does not need a jet stream of water to initiate the siphonic effect.

Another object of the present invention is to provide a siphon flush apparatus, which does not need a piston to initiate the siphonic process.

One other object of the present invention is to provide a siphon flush apparatus which does not need any valve means to initiate the siphonic process.

It is yet another object of the present invention to provide a siphon flush apparatus, which can remain without any leakage into the flushing tube.

An additional object of the present invention is to provide a siphon flush apparatus having a simple construction such that the maintenance thereof be cheap and easy.

BRIEF DESCRIPTION OF THE DRAWINGS

The novel features that are considered characteristic of the present invention are set forth with particularity in the appended claims. The invention itself, however, together with other objects and advantages thereof will be best understood in the following detailed description of certain embodiments, when read in connection with the accompanying drawings, wherein:

DETAILED DESCRIPTION OF THE INVENTION

Figure 1:
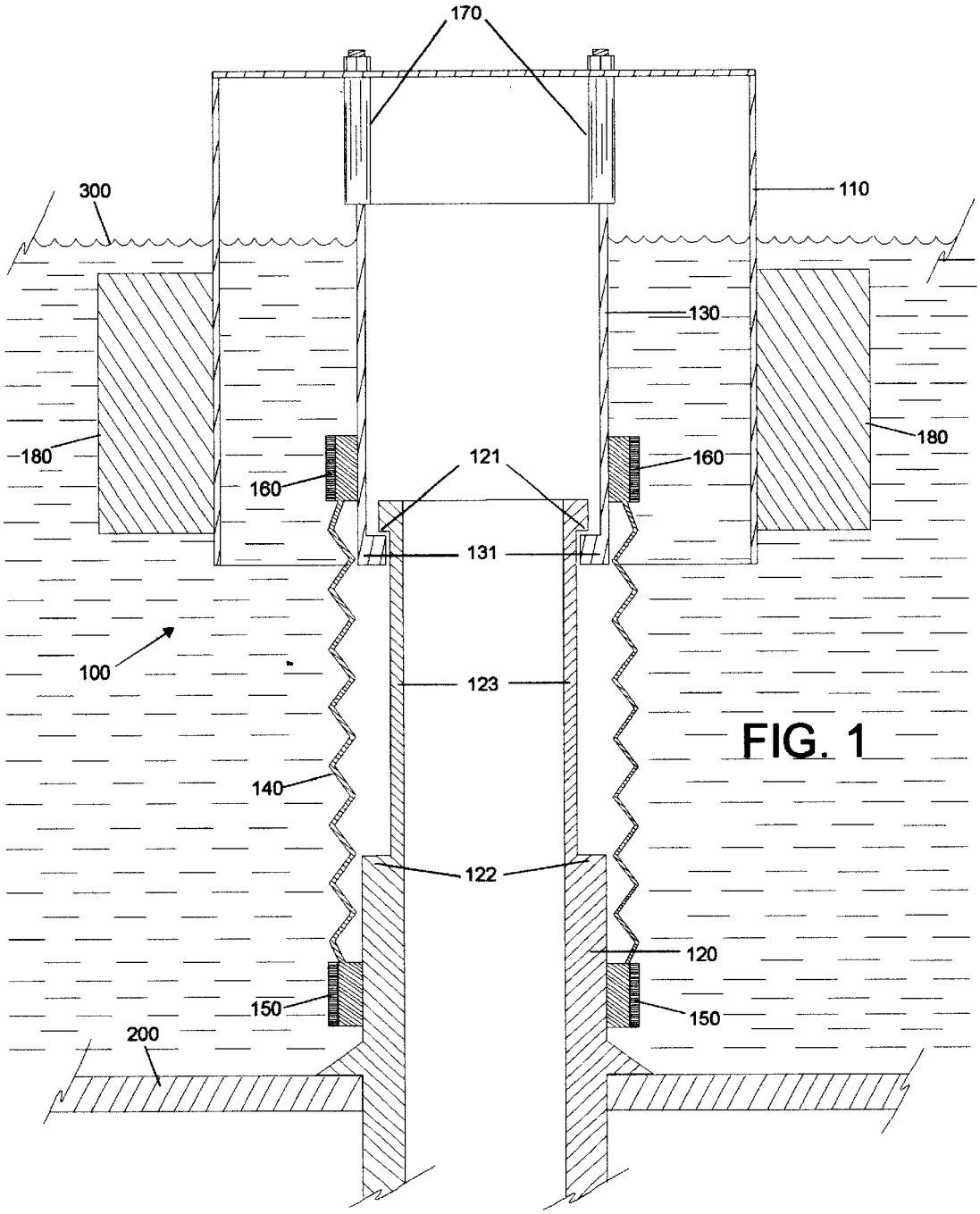
FIG. 1 is a cross-sectional view of the siphon flush apparatus set in its rest position, built according to the principles of the present invention.

Having now more particular reference to the drawings, and more specifically to FIG. 1, there is shown a preferred embodiment of the siphon flush apparatus 100 of the present invention. The siphon flush apparatus comprises a discharge conduct 120 extending upwardly from beyond the bottom surface of the cistern 200 and having a height lower than the maximum water level 300 in the cistern 200; a sliding conduct 130, having a length enough to rise above the maximum water level 300 in the cistern 200 when the bottom of said sliding conduct 130 is at the top of the discharge conduct 120, the sliding conduct 130 being concentric to the discharge conduct 120 and having a sectional area enough to house said discharge conduct 120; a flow directing element 110 for initiating and, maintaining a siphon by directing water flow towards the top of the sliding conduct 130; sealing means, for providing a seal between the discharge and sliding conducts and operatively joining each other; fastening means 170 for joining the sliding conduct to the flow directing element 110 and for providing a space between the top of the sliding conduct 130 and the flow directing element 110 for allowing water flow; floating means 180 for moving flow directing element 110 upwards along with the sliding conduct 130; first stopping means (121 and 131) for preventing sliding conduct 130 to move upwardly beyond discharge conduct 120; and, second stopping means (131 and 122) to prevent sliding conduct 130 to reach the bottom of the sealing means when it is moved downwards.

In the preferred embodiment of the present invention, the sealing means are a sleeve 140 further comprising fixing means for joining said sleeve 140 to the discharge and sliding conducts 120 and 130, respectively.

In a preferred embodiment of the present invention, the fixing means of sleeve 140 are preferably selected from adhesive means, such as contact adhesives; mechanical means, such as clamps, pins, bolts and clasps; and combinations thereof.

In the preferred embodiment of FIG. 1, the fixing means of sleeve 140 are a pair of peripheral clamps 150 and 160, respectively located at the lower and upper ends of sleeve 140. Peripheral clamps 150 and 160 have the function of respectively clamping sleeve 140 to discharge conduct 120 and sliding conduct 130, as shown in FIG. 1. In both ends of sleeve 140, a perfect seal is obtained between the sleeve and the conducts due to the pressure exerted by the clamps, which prevents water from flowing through the gaps that may be present between sliding conduct 130 and discharge conduct 120.

On the other hand, the fastening means are preferably selected from bolts; pins; projections; flanges; threaded elements; combinations thereof; or any other fastening means that can provide a space to water flow.

In a preferred embodiment of the present invention, fastening means 170 are a plurality of bolts integral to the upper edge of sliding conduct 130, for joining said conduct with the upper part of flow directing element 110, each bolt further comprising a fixing element such as a nut or the like, for fixing the top of said flow directing element 110 to the bolts, as shown in FIG. 1.

When sleeve 140 is worn out, it can be replaced by removing the nuts on the top of flow directing element 110 and lifting the latter so as to expose clamp 160. Subsequently, peripheral clamps 150 and 160 should be unfastened to allow the worn sleeve to be removed and replaced by a new one. Once the new sleeve is installed, the clamps are fastened again and the flow-directing element 110 can be reassembled, following the reverse steps.

In regard to the operation of siphon flush apparatus 110 of the present invention, FIG. 1 shows the apparatus 110 set in its rest position, i.e. upper position, when the cistern 200 is filled and ready to initiate a flushing operation. At this position, flow directing element 110 is at its maximum height, wherein both the top of the flow-directing element 110 and the upper part of the sliding conduct 130 are located above the maximum water level 300, so as to prevent water flow into the flushing bowl (not shown in the figures).

The initial upper position of flow directing element 110 is maintained by means of floating means 180, while the upward movement of the flow directing element 110 due to said floating means is stopped by the first stopping means. In the preferred embodiment of FIG. 1, the first stopping means are preferably a first peripheral projecting portion 131 at the bottom of the sliding conduct 130 and a second peripheral projecting portion 121 at the top of the discharge conduct 120.

A perfect sealing between the discharge conduct 130 and the sliding conduct is achieved by means of a sleeve 140, which is preferably made of a flexible material such as rubber latex or the like. In a preferred embodiment, sleeve 140 has a design that allows it to contract and expand lengthwise. As could be seen in the figures, sleeve 140 includes preferably a zigzag pattern along its lateral walls, which allows said sleeve to be compressed and decompressed as sliding conduct 130 is moved downwards and upwards during flushing and filling operations but still maintaining the sealing condition to prevent water from leaking. The upper end of sleeve 140 is fastened by peripheral clamp 160 to a lower part of sliding conduct 130; while the lower part of sleeve 140 is fastened by peripheral clamp 150 to a part of discharge conduct 120 lower than the second stopping means.

Figure 2:
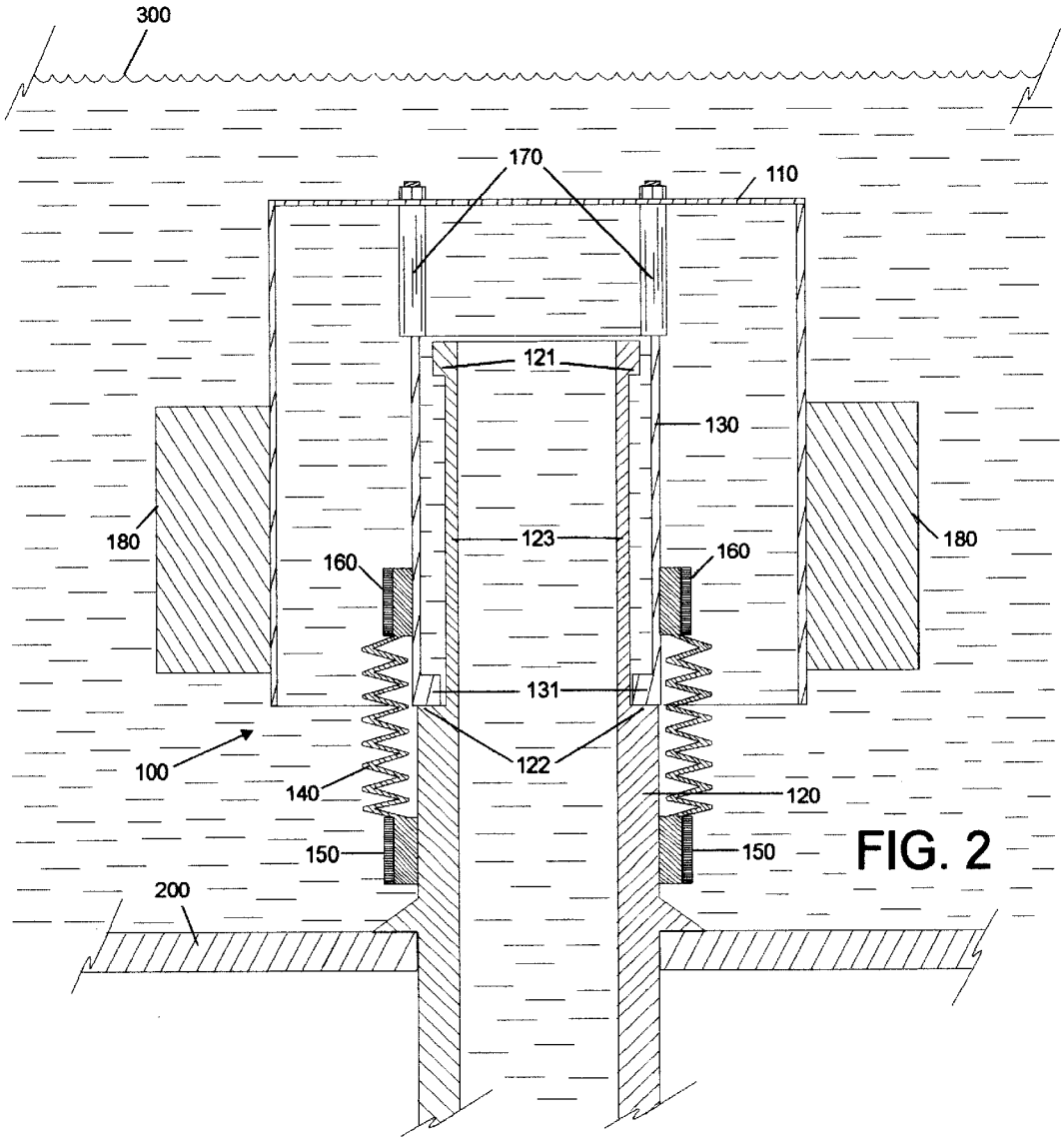
FIG. 2 is a cross-sectional view of the siphon flush apparatus of FIG. 1 in operation.

In order to initiate the flushing of the cistern, flow-directing element 110 is pushed downwards along with sliding conduct 130 so as to reach the position shown in FIG. 2. This is made in a single operation that makes the sliding conduct to slide down on its peripheral projecting portion 131 through a sliding path 123 that is formed in discharge conduct 120 due to the configuration of the first and second stopping means of the embodiment under description. Sliding conduct 130 descends until it reaches the second stopping means, wherein the sliding path 123 ends. In the preferred embodiment, the second stopping means consist of the first peripheral projecting portion 131 of the first stopping means, and a third peripheral projecting portion 122 located at the lower part of discharge conduct 120.

When sliding down flow directing element 110 as described above, it goes completely beneath the water level 300 and the water is forced to flood the chambers of said element until water reaches the top of sliding conduct 130 thus starting the siphon that allows water to flow towards the flushing bowl, which is in a lower position. At this point, sleeve 140 becomes compressed as shown in FIG. 2.

The flushing operation is stopped when the siphon is broken due to the fact that water level 300 reaches the bottom of flow directing element 110, thus allowing air to enter.

As it might be clear for those skilled in the art, the force with which floating means 180 push the flow-directing element 110 upwards should be less than the force needed to break the siphon during the flushing operation. Nevertheless, floating means 180 should exert enough force to move flow-directing element 110 upwards once the siphon is broken due to lack of water supply.

After finishing the flushing operation, the floating means 180 are used to allow the flow directing element 110 to return to its original position when filling the cistern. The cistern can be refilled using a conventional float operated water supply valve as those well known in the art. The water level is refilled to a level lower than the height of the upper end of sliding conduct 130 in the rest position.

It is worth mentioning that when the conventional supply valve fails, there is no need of an additional overflowing discharging pipe as employed in the prior art. Should said failure occur, flow directing element 110 would guide water towards the upper end of sliding conduct 130, said conduct acting as an overflow discharge pipe until the supply valve is fixed and water level is again lower than the height of said conduct in rest position.

In a preferred embodiment of the invention, floating means 180 are a pair of floats located on opposite sides of the sidewalls of flow directing element 110, preferably coincident with the longest axis of the cistern.

In another embodiment, the floating means are at least one float of any shape or arranged, such as a single circular float, provided that they are able to move the flow directing element upwards.

In an additional embodiment of the invention, flow directing element 110 includes an opening 600, preferably at the top, for introducing a hose 700 that end directly in sliding conduct 130 to fill the flushing bowl up to a convenient level, in accordance with the design of the corresponding supply valve.

Figure 3:
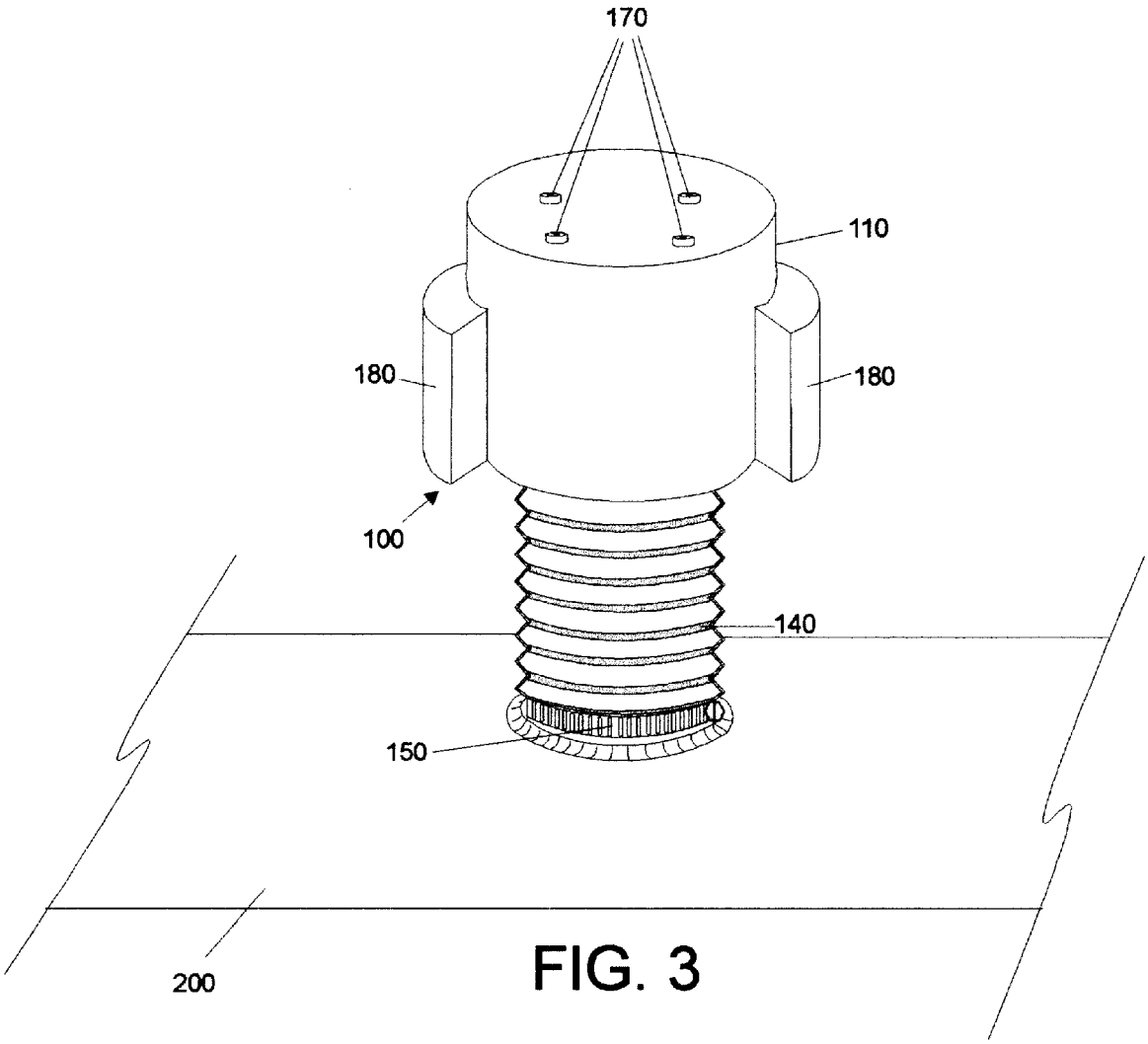
FIG. 3 is a perspective view of the siphon flush apparatus of figure

Finally, the perspective view of the apparatus of the present invention of FIG. 3, allows a better understanding of a preferred embodiment of the shape of the invention. There can be appreciated the external parts of flow directing element 110; fastening means 170; sleeve 140; clamp 150; and, floating means 180.

Figure 4:
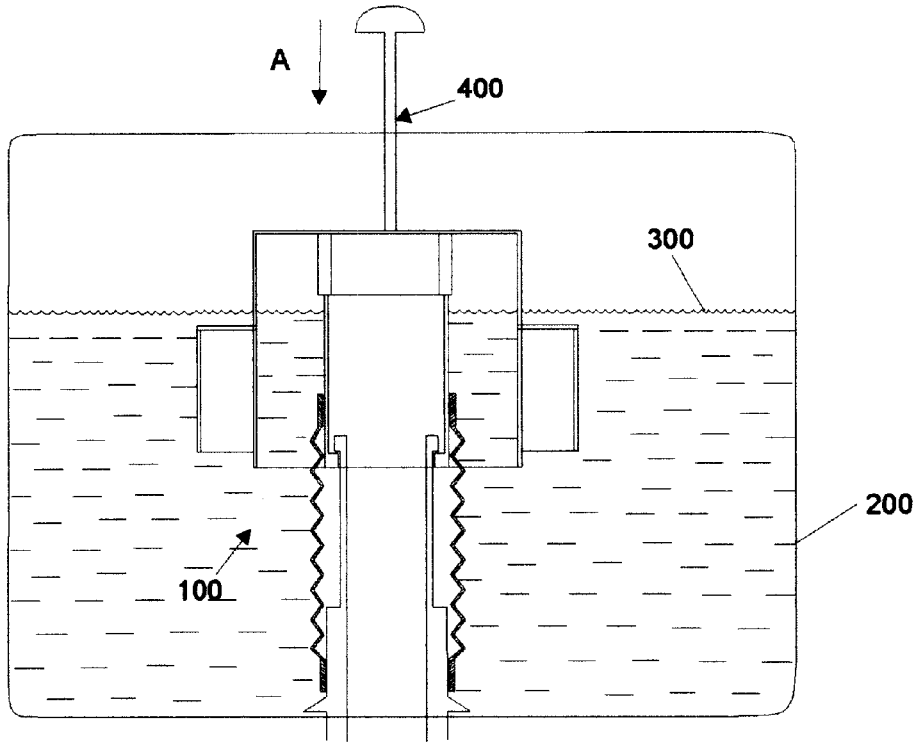
FIG. 4 represents a cross-sectional view of preferred embodiment of the push means of the siphon flush apparatus of FIG. 1.

On the other hand, pushing means, which are well known in the art, are needed to push the flow-directing element downwards and begin the siphon action. In a preferred embodiment of the present invention as shown in FIG. 4, a siphon flush apparatus is coupled to a vertical shaft 400 for performing the pushing action in direction A.

Figure 5:
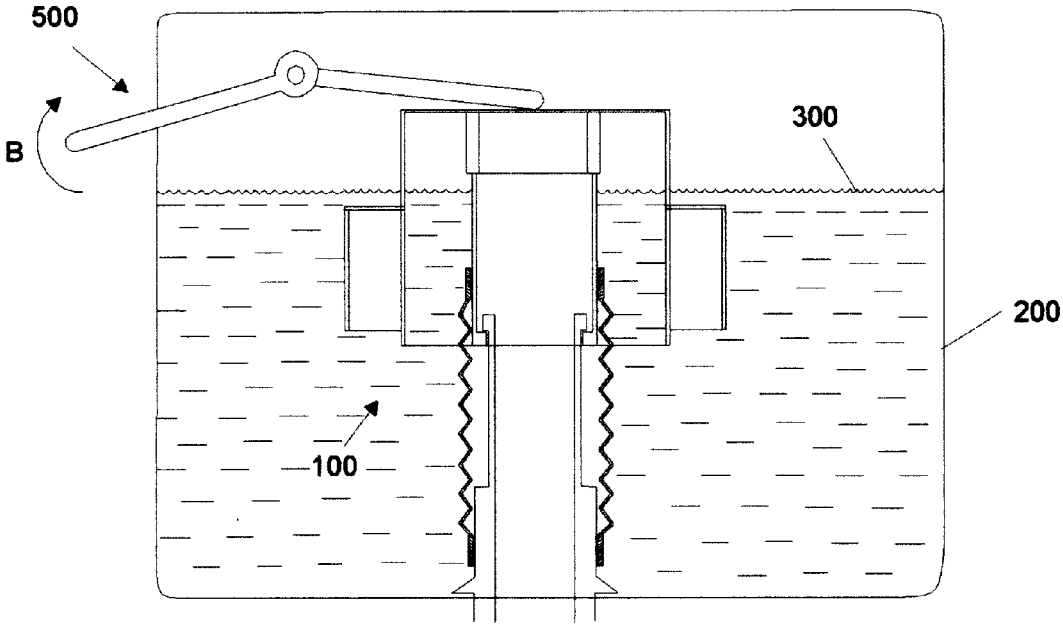
FIG. 5 represents a cross-sectional view of another embodiment of the push means of the siphon flush apparatus of FIG. 1.

Likewise, FIG. 5 shows a siphon flush apparatus that is coupled to a lever 500, such as those used in the prior art. Said lever when pulled upwards in B direction subsequently pushing down flow-directing element 110.

In accordance to what is described above, it may be observed that the siphon flush apparatus of the present invention has been designed so as to prevent water leakage while the apparatus is at the rest position but still forming a siphon without needing additional valve means or piston actions. Furthermore, it will be evident to those skilled in the art that the embodiments of the siphon flush apparatus described herein above and illustrated in the attached drawings are only illustrative and not limitative of the present invention, as there are many possible changes in its details without stepping apart from the scope of the invention.

Although certain specific embodiments of the present invention have been illustrated and disclosed above, it is to be understood that many modifications thereof are possible, such as different shapes of the flow directing element, different nature and materials of the fixing or fastening means, different configurations of the stopping means, as well as different design or materials of the sealing and floating means. The present invention, therefore, is not to be restricted except insofar as is necessitated by the prior art and by the spirit of the enclosed claims.

What is claimed is:

1. A siphon flush apparatus comprising a discharge conduct extending upwardly from a bottom surface of a cistern and having a height lower than a maximum water level in the cistern; a sliding conduct having a length rising above the maximum water level in the cistern when a bottom of said sliding conduct is at a top of the discharge conduct, the sliding conduct being concentric to the discharge conduct and having a sectional area large enough to house said discharge conduct; a flow directing element for initiating and maintaining a siphon by directing water flow towards a top of the sliding conduct, sealing means engaged between the bottom of the sliding conduct and a top of the discharge conduct for providing a seal between the discharge and sliding conducts and operatively joining each other; fastening means fix to the top of sliding conduct for separably engaging the sliding conduct to the flow directing element and for providing a space between the top of the sliding conduct and the flow directing element for allowing water flow; floating means for moving said flow directing element upwards along with the sliding conduct; first stopping means for preventing the sliding conduct from moving upwardly beyond the discharge conduct; and, second stopping means to prevent the sliding conduct from reaching a bottom of the sealing means when the sliding conduct moves downwards.

2. A siphon flush apparatus, according to claim 1, wherein the sealing means further comprise fixing means for joining the sealing means to said conducts.

3. A siphon flush apparatus, according to claim 2, wherein the fixing means are selected from adhesive means; mechanical means; and, combinations thereof.

4. A siphon flush apparatus, according to claim 3, wherein the adhesive means are contact adhesives.

5. A siphon flush apparatus according to claim 3, wherein the mechanical means are selected from clamps; pins; bolts; clasps; and combinations thereof.

6. A siphon flush apparatus according to claim 2, wherein the sealing means are a sleeve.

7. A siphon flush apparatus according to claim 6, wherein the fixing means are a pair of peripheral clamps, respectively located at the lower and upper ends of the sleeve, said clamps respectively clamping by its ends the sleeve to the discharge conduct and the sliding conduct, thereby forming a perfect seal the sleeve and the conducts due to the pressure exerted by the clamps.

8. A siphon flush apparatus according to claim 6, wherein the sleeve is made of a flexible material.

9. A siphon flush apparatus according to claim 8, wherein the flexible material is rubber latex.

10. A siphon flush apparatus according to claim 8; wherein the sleeve have a design that allows it to contract and expand along its length.

11. A siphon flush apparatus according to claim 10, wherein the sleeve includes a zigzag pattern along its lateral walls, which allows said sleeve to be compressed and decompressed as the sliding conduct is moved downwards and upwards during flushing and filling operations but still maintaining the sealing condition to prevent water from leaking.

12. A siphon flush apparatus according to claim 11, wherein the fastening means are bolts.

13. A siphon flush apparatus according to claim 12, wherein the bolts are integral to the upper edge of the sliding conduct for joining said conduct with the upper part of the flow directing element, each bolt further comprising a fixing element for fixing the top of said flow directing element to the bolts.

14. A siphon flush apparatus according to claim 13, wherein the fixing element is a nut.

15. A siphon flush apparatus according to claim 1, wherein the first stopping means are preferably a first peripheral projecting portion at the bottom of the sliding conduct and a second peripheral projecting portion at the top of the discharge conduct; and the second stopping means consist of the same first peripheral projecting portion located at the lower part of discharge conduct, thus forming at the discharge conduct a sliding path between the second and third peripheral portions thereof.

16. A siphon flush apparatus according to claim 1, wherein the floating means are a pair of floats located on opposite sides of the side walls of the flow directing element.

17. A siphon flush apparatus according to claim 1, wherein the floating means are a single float located around the flow-directing element.

18. A siphon flush apparatus according to claim 1, wherein the flow-directing element is pushed down by means of pushing means.

19. A siphon flush apparatus according to claim 18, wherein the pushing means are a vertical shaft.

20. A siphon flush apparatus according to claim 18, wherein the pushing means are a lever that is pulled upwards in order to push down flow-directing element.

* * * * *

UNITED STATES PATENT AND TRADEMARK OFFICE

CERTIFICATE OF CORRECTION

PATENT NO. : 6,473,912 B2
DATED : November 5, 2002
INVENTOR(S) : Jose-Jaime Preciado-Villanueva It is certified that error appears in the above-identified patent and that said Letters Patent is hereby corrected as shown below:

Column 7,
Line 22, delete "11" and insert therefor -- 1 --

Column 8,
Line 8, after "portion", insert -- of the first stopping means, and a third peripheral projecting portion --

Signed and Sealed this

Second Day of September, 2003

JAMES E. ROGAN
*Director of the United States Patent and Trademark Office*